United States Patent [19]

Moller et al.

[11] 4,061,475

[45] Dec. 6, 1977

[54] PROCESS FOR PRODUCING A GAS WHICH CAN BE SUBSTITUTED FOR NATURAL GAS

[75] Inventors: Friedrich-Wilhelm Moller, Friedrichsdorf; Karl Bratzler, Bad Homburg; Wolf-Dieter Müller, Nieder-Eschbach, all of Germany

[73] Assignee: Metallgesellschaft Aktiengesellschaft, Frankfurt am Main, Germany

[21] Appl. No.: 773,109

[22] Filed: Feb. 28, 1977

Related U.S. Application Data

[63] Continuation of Ser. No. 592,301, July 1, 1975, abandoned.

[30] Foreign Application Priority Data

July 9, 1974 Germany ..... 2432887

[51] Int. Cl.[2] ..... C10J 3/00; C10K 3/02

[52] U.S. Cl. ..... 48/197 R; 48/202; 48/206; 260/449 M

[58] Field of Search ..... 48/202, 206, 210, 197 R, 48/215; 252/373; 260/449 M

[56] References Cited

U.S. PATENT DOCUMENTS

| | | | |
|---|---|---|---|
| 3,927,999 | 12/1975 | Child et al. | 48/197 R |
| 3,928,000 | 12/1975 | Child et al. | 48/197 R |

*Primary Examiner*—Robert L. Lindsay, Jr.
*Assistant Examiner*—George C. Yeung
*Attorney, Agent, or Firm*—Burgess, Dinklage & Sprung

[57] ABSTRACT

A high methane gas which can be substituted for natural gas is produced from a primary gas made by the gasification of coal, tar, or heavy residual oil under superatmospheric pressures. The primary gas is purified to remove catalyst poisons and is scrubbed to remove carbon dioxide to a residual content below 2% by volume. The water vapor to carbon monoxide volume ratio of the scrubbed gas is adjusted to 0.55 : 1 to 1 : 1 and is then passed through a reaction zone containing a shift conversion catalyst and a methanation catalyst in a volume ratio of approximately 1 : 4 to 1 : 10. The scrubbed gas entering the reaction zone enters the reaction zone at a temperature of 300°–500° C.

2 Claims, 2 Drawing Figures

PROCESS FOR PRODUCING A GAS WHICH CAN BE SUBSTITUTED FOR NATURAL GAS

This is a continuation of application Ser. No. 592,301, filed July 1, 1975 now abandoned.

BACKGROUND

This invention relates to a process of producing a high-methane gas, which can be substituted for natural gas, from a primary gas which has been produced by a gasification of coal, tar, or heavy residual oil under superatmospheric pressure and which has been purified to remove catalyst poison and has been scrubbed to remove carbon dioxide to a residual content below 2% by volume. Heavy residual oils are hydrocarbons which boil above 250° C.

Such gas which can be substituted for or mixed with natural gas should contain at least 90% by volume methane and less than 2% by volume hydrogen. The gas should be virtually free of carbon monoxide. A residual carbon dioxide content is generally not disturbing. It is known that coal, tar, and heavy residual oil can be degasified with water vapor and oxygen under superatmospheric pressure and at elevated temperatures to produce a raw gas which contains carbon oxides in excess of its hydrogen content. The raw gases produced by the gasification of coal with water vapor and oxygen under a pressure of 20–80 kg/cm² absolute pressure generally have a high $CO_2$ content (28–32% by volume) and CO content (15–20% by volume) and a relatively low $H_2$ content (35–44% by volume). The gasification of tars and residual oils is carried out at higher temperatures (about 1100°–1500° C) than the gasification of coal and results in a raw gas which contains 3–6% by volume $CO_2$, 46–50% by volume CO, and 40–48% by volume $H_2$.

These oxides of carbon contained in the gas produced by gasification are hydrogenated to produce methane preferably in contact with a high-activity hydrogenation catalyst, which contains metallic nickel as its active component. The reaction of CO and CO with hydrogen to produce methane and water is also referred to as methanation and takes place in accordance with the following reaction equations:

$$CO + 3\,H_2 \rightleftarrows CH_4 + H_2O$$

$$CO_2 + 4\,H_2 \rightleftarrows CH_4 + 2\,H_2O$$

and is accompanied by a heat change of 49.3 kcal/mole CO and 39.4 kcal/mole $CO_2$.

It is apparent that 3 moles $H_2$ per mole CO are required to hydrogenate carbon monoxide to form methane and 4 moles $H_2$ are required to hydrogenate 1 mole $CO_2$. For this reason the volume ratio $$H_2 : (3\,CO + 4\,CO_2)$$

which is defined as the stoichiometric ratio, must be equal to or larger than 1 for a complete conversion of the carbon oxides to methane. Because $CO_2$ can be scrubbed in a simple manner from the product gas after the synthesis of methane, $CO_2$ need not be hydrogenated to methane as completely as possible. On the other hand, a complete hydrogenation of CO is essential because CO which has not been hydrogenated and remains in the product gas is undesired and can be removed only with great difficulty. To increase the above-mentioned stoichiometric ratio $H_2 : (3\,CO + 4\,CO_2)$, part of the $CO_2$ or in most cases all of the $CO_2$ must be removed. This is accomplished by the purification of the gas which is required for a complete removal of the catalyst poisons ($H_2S$, organic sulfur compounds, HCN, and $NH_3$) from the gas. The gas is scrubbed with a physically or chemically acting absorbent to remove the carbon dioxide to a residual content of a few percent.

Even when the $CO_2$ has been scrubbed out, the $H_2 : 3\,CO$ volume ratio is still below the required minimum of 1. To increase the ratio to that value, part of the carbon monoxide is subjected to the known catalytic shift conversion reaction with water vapor according to the reaction equation $$CO + H_2O \rightarrow CO_2 + H_2$$

to produce hydrogen and $CO_2$.

This results in the previously known process sequence, which is shown in FIG. 2 of the drawing described below.

This process has the significant disadvantage that steam at a high rate must be supplied for the shift conversion and only 20–30% of this steam directly participate in the shift conversion reaction. The remaining 70–80% of the steam are merely ballast, which serves mainly to limit the adiabatic temperature rise. The extraneous generation of this ballast steam and its subsequent removal by condensation involve considerable costs.

SUMMARY

This invention provides a process which is of the kind mentioned first hereinbefore and which can be carried out in a simpler manner and at lower costs than the processes known in the art. This is accomplished according to the invention in that the scrubbed gas is adjusted to a water vapor to carbon monoxide volume ratio of 0.55:1 to 1:1 and is passed through a reaction zone, which is entered by the gas at a temperature of 300°–500° C and which contains a shift conversion catalyst and a methanation catalyst in a volume ratio of approximately 1:4 to 1:10. The addition of ballast water vapor is omitted and is substituted by a combination of the shift conversion reaction with the methanation reaction, which produces water vapor. As the shift conversion and the methanation are performed in the same reaction vessel, there is no need for a separate shift conversion unit. The pressure in the reaction vessel is about 10–100 kg/cm² absolute pressure, preferably 20–60 kg/cm² absolute pressure.

DESCRIPTION

Both catalysts may be of known type. For instance, the shift conversion catalyst may be a mixture of iron oxide and chromium oxide. The methanation catalyst usually contains 20–60% by weight nickel on a support which is resistant to water vapor. The support may consist of, e.g., alumina, magnesium silicate, or magnesium spinel.

The temperature at which the gas enters the reactor which contains the shift conversion and methanation catalysts is suitably adjusted to that the temperature of the gas leaving the methanation catalyst is not in excess of 600° C and preferably below 480° C. The two different catalysts are arranged, e.g., in such a manner that the shift conversion catalyst forms a separate bed, which precedes the methanation catalyst. According to a preferred feature of the invention, no shift conversion catalyst which differs from the methanation catalyst is used. Whereas the nickel-containing methanation catalyst does not ideally promote the shift conversion reaction, its activity is sufficient for a conversion of part of the CO content. The remaining CO is consumed by the methanation reaction.

Desirably a partial stream of the product gas leaving the reaction zone is recycled to a point which precedes the reaction zone, said partial stream is mixed in a volume ratio of 2:1 to 6:1 with scrubbed primary gas, and the mixture is fed into the reaction zone. As a result of the methanation reactions the recycled product gas contains already the water vapor which is required for the performance of the shift conversion reaction (4) to the desired extent. If additional water vapor is required for the shift conversion reaction, it will be sufficient to add it only in an amount of 25–40% of the amount which must be added in known processes.

DESCRIPTION OF THE DRAWING

The process will be explained more fully with reference to the drawing, in which

In FIGS. 1 and 2, a unit 1 is used for the pressure gasification of coal, tar or residual oil by a treatment with oxygen and water vapor under a pressure of about 20–60 kg/cm$^2$ to produce the raw gas. Tar will be removed from the raw gas if this is required. In the scrubber 2, the raw gas is purified to remove catalyst poison and also to remove the carbon dioxide to a residual content below 2% by volume, preferably below 1% by volume.

Figure 1:
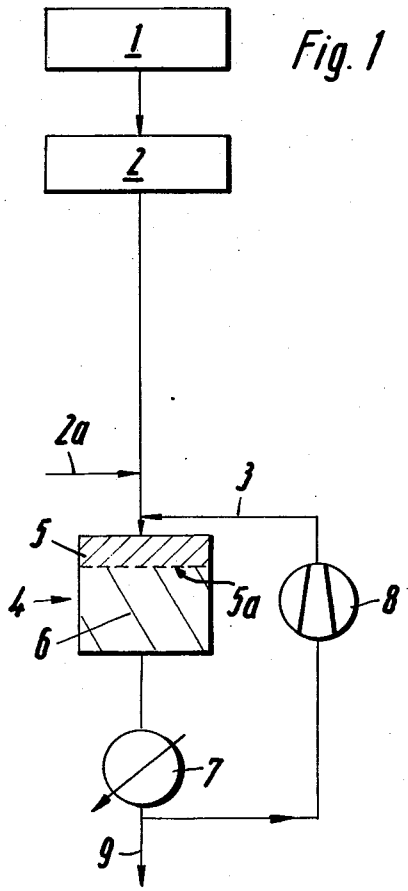

In the process according to the invention shown in FIG. 1, the scrubbed gas together with recycled product gas from conduit 3 is directly supplied into a reactor 4, in which the gaseous constituents are shift-converted and methanated. Any additional water vapor which is required is supplied to the gas through conduit 2*a*. The synthesis gas from the scrubber is adjusted to a volume ratio of 0.55:1 to 1:1 of water vapor to CO. The reactor 4 contains an upper bed 5 consisting of a shift conversion catalyst and below the same a methanation catalyst 6. The interface between the two catalysts 5 and 6 is permeable to gas and is formed, e.g., by a grate 5*a*. The arrangement shown in FIG. 1 may be modified in that the reactor 4 contains only the methanation catalyst 6 and no separate shift conversion catalyst therefore grate 5*a* can be omitted. The methanation catalyst 6 may be divided into separate layers, which are not shown on the drawing.

The product gas from the reactor 4 is cooled in the cooler 7. A partial stream of this gas is recycled by means of a compressor 8 in conduit 3. The remainder of the gas in conduit 9 is supplied (by means not shown) to the final methanation stage, where the methane content of the gas is increased to the desired value. When part of the residual carbon dioxide has been scrubbed off, the gas is available in a form in which it can be substituted for natural gas.

Figure 2:
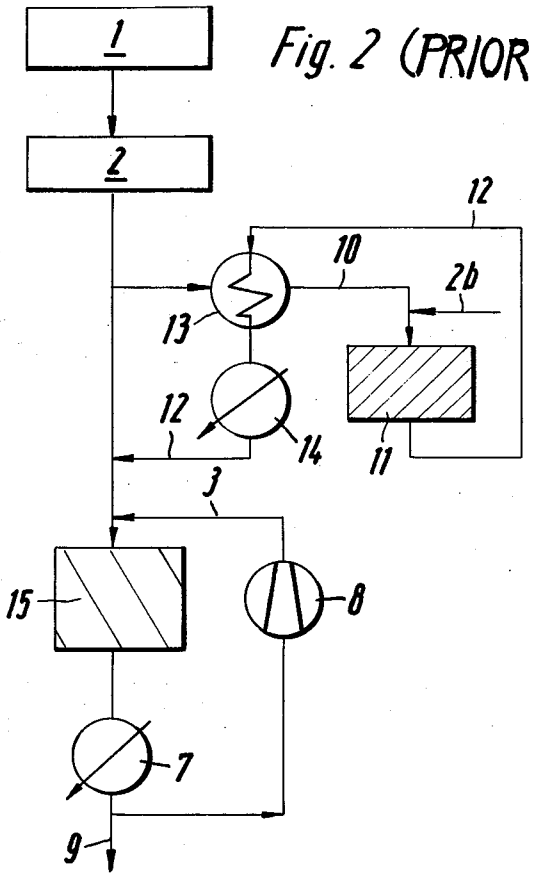
Fig. 2 (PRIOR ART)
FIG. 1 is a diagrammatic representation showing the parts which are essential for the process according to the invention and FIG. 2 is a view similar to FIG. 1 and represents a known process.

In the known process shown in FIG. 2 the primary gas is divided behind the scrubber 2. About one-half of the gas is conducted in conduit 10 to the shift conversion unit 11. The water vapor required for the shift conversion is added in conduit 2*b*. The product gas produced by shift conversion is passed in concuit 12 to a heat exchanger 13 and is cooled in the latter by means of feed gas and subsequently passed through the cooler 14 to remove surplus water vapor by condensation. The condensate is withdrawn by means which are not shown. The partial stream consisting of the shift-converted gas is added to the partial stream which has not been shift-converted, and the resulting mixed gas is passed through the methanation reactor 15 together with product gas which has been recycled through conduit 3. The process is then continued as has been explained with reference to FIG. 1.

The process shown in FIG. 1 is much simpler than the known process shown in FIG. 2. The separate shift-conversion unit 11, the heat exchanger 13 and the after-cooler 14 required in the known process are eliminated in the process of FIG. 1. In the conventional process the surplus water vapor contained in the shift-converted partial stream must be condensed out before the gas enters the methanation reactor. The removal by condensation is necessary to ensure that the methanation which is effected in the reactor 15 and results in a formation of water proceeds until all carbon monoxide has been reacted and the water vapor is also consumed in a considerable degree. The condensation involves an energy loss, which is avoided in the process according to the invention.

In the known process shown in FIG. 2, additional water vapor is required for the shift conversion of a partial stream of the primary gas. In the process of FIG. 1 this additional water vapor is substituted in a high degree by the water vapor produced by the methanation. The additional amount of steam required for the shift conversion is reduced to 25–40% of the amount required in the known process of FIG. 2. In the process according to the invention the water vapor produced by the methanation is recycled with the product gas in conduit 3 into the gas mixture which is to be reacted. The recycled gas serves also to dilute the fresh gas from the scrubber 2 so that an excessive adiabatic temperature rise in the reactor 4 is avoided.

Because only one reactor 4 is required for the process according to the invention rather than the two reactors 11 and 15 required for the known process, a smaller amount of catalyst is sufficient in the process according to the invention. It has been found that for a given output the total amount of catalyst required in the process according to FIG. 1 is only about one-half of the total amount of catalyst required in the known process.

The advantages afforded by the process according to the invention will be set forth even more clearly by a numerical example. The same relates to a scrubbed primary gas which has been produced by the pressure gasification of coal and is available at a rate of 100,000 standard m$^3$/h. The gas has the following composition in percent by volume:

| | |
|---|---|
| $CO_2$ | 1.0 |
| CO | 27.3 |
| $H_2$ | 45.3 |
| $CH_4$ | 16.9 |
| $N_2$ | 0.5 |

For the further processing of the gas in accordance with FIG. 1, 0.2 standard *m*$^3$ steam are added per standard *m*$^3$ gas. This is equivalent to 18 metric tons of steam per hour.

In the process according to FIG. 2, one-half of the gas is branched off to be subjected to shift conversion, and steam at a rate of 48.3 metric tons per hour is added to said branched-off gas. This is equivalent to 0.6 standard $m^3$ steam per standard $m^3$ of the entire gas from the scrubber 2. 25 $m^3$ catalyst are required for the shift conversion in 11. Humid gas at a rate of 110,000 standard $m^3$/h leave the shift conversion stage 11. The rate of dry gas is 61,887 standard $m^3$ per hour. The gas in conduit 12 has the following composition:

| | |
|---|---|
| $CO_2$ | 20.02 % by volume |
| CO | 2.85 % by volume |
| $H_2$ | 63.08 % by volume |
| $CH_4$ | 13.65 % by volume |
| $N_2$ | 0.40 % by volume |
| $H_2O$ | 0.77 standard $m^3$ per standard $m^3$ gas |

In the process of FIG. 2, a mixture of shift-converted gas and gas which has not been shift-converted is formed at a rate of 111,887 standard $m^3/h$. This mixture has the following composition in percent by volume:

| | |
|---|---|
| $CO_2$ | 11.52 |
| CO | 13.77 |
| $H_2$ | 59.16 |
| $CH_4$ | 15.10 |
| $N_2$ | 0.45 |

This mixture formed in the process according to FIG. 2 is to be compared to the scrubbed primary gas which is formed in the process according to FIG. 1 and which has the composition stated above.

The numerical values relating to the gas formed in the process according to FIG. 1 will now be reported, partly in Column I of each table, which contain in Column II the comparable values relating to the gas formed in the process according to FIG. 2.

| | I | II |
|---|---|---|
| $H_2$:CO volume ratio | 1.99 | 4.3 |
| Stoichiometric ratio $H_2 : (3\ CO + 3\ CO_2)$ | 0.63 | 0.68 |

This gas is fed into reactor 4 or 15.

The humid product gas produced by the reaction in reactor 4 under a pressure of 20 kg/cm² absolute pressure and at a rate of 614,009 standard m³/h has an outlet temperature of 460° C. The corresponding product gas of the methanation reactor 15 in FIG. 2 becomes available at a rate of 533,946 standard m³/h. The product gases have the following compositions:

| | I | II |
|---|---|---|
| $CO_2$ | 17.83 | 17.58 % by vol. |
| CO | 0.40 | 0.45 % by vol. |
| $H_2$ | 11.0 | 8.2 % by vol. |
| $CH_4$ | 69.78 | 72.76 % by vol. |
| $N_2$ | 0.98 | 1.01 % by vol. |
| $H_2O$ | 0.697 | 0.471 standard $m^3$ per standard $m^3$ gas |

| | I | II |
|---|---|---|
| Rate of gas recycled in conduit 3 (standard m³/h) | 526,875 | 460,707 |
| Total gas rate in reactor 4 or 15 (standard m³/h) | 626,875 | 572,594 |
| Methanation catalyst (m³) | 29.5 | 28.6 |
| Total amount of catalyst inclusive of shift conversion catalyst (m³) | 32.6 | 53.6 |
| Product gas withdrawn through conduit 9 (standard m³ of dry gas per hour) | 51,352 | 49,778 |

The methanation catalyst consisted of 50% by weight nickel on a magnesium spinel support. In the process according to FIG. 1 (Column I), this catalyst was used also to promote the shift conversion.

What is claimed is:

1. A process for producing a high-methane gas which can be substituted for natural gas, from a primary gas containing 35–44% by volume hydrogen, 15–20% by volume carbon monoxide and 28–32% by volume carbon dioxide produced by the gasification of coal with water vapor and oxygen under a pressure of 20–80 kg/cm² comprising the steps of:

a. purifying said primary gas by removing catalyst poisons and removing carbon dioxide to a residual content below 2% by volume;

b. adjusting the water vapor to carbon monoxide volume ratio of the scrubbed gas to 0.55 : 1 to 1 : 1;

c. passing said gas of step (b) through one reaction zone containing only a methanation catalyst containing 20–60% by weight of nickel on a support which is resistant to water vapor, the temperature of the gas entering said reaction zone being in the range of 300°–500° C and the temperature of the gas leaving the methanation catalyst being below 480° C;

d. supplying the gas leaving the reaction zone to a final methanation stage to produce a high-methane gas; and e. removing residual carbon dioxide from said high-methane gas to produce said gas to be substituted for natural gas.

2. The process of claim 1 wherein said support of step (c) is selected from the group consisting of alumina, magnesium silicate and magnesium spinel.

* * * * *